US007866235B2

(12) United States Patent
Hi

(10) Patent No.: US 7,866,235 B2
(45) Date of Patent: Jan. 11, 2011

(54) MULTI-ANGLE TOOL HANDLE

(76) Inventor: Fanny Hi, No. 16, Lane 63, Lising St., Yilan City, Yilan County (TW)

( * ) Notice: Subject to any disclaimer, the term of this patent is extended or adjusted under 35 U.S.C. 154(b) by 219 days.

(21) Appl. No.: 12/354,020

(22) Filed: Jan. 15, 2009

(65) Prior Publication Data

US 2009/0223329 A1 Sep. 10, 2009

Related U.S. Application Data

(63) Continuation-in-part of application No. 12/042,455, filed on Mar. 5, 2008, now Pat. No. 7,698,972.

(51) Int. Cl.
*B25B 23/16* (2006.01)

(52) U.S. Cl. ..... 81/177.8; 81/177.7

(58) Field of Classification Search ..... 81/177.2, 81/177.5–177.7, 177.8
See application file for complete search history.

(56) References Cited

U.S. PATENT DOCUMENTS

| | | | | |
|---|---|---|---|---|
| 579,277 | A | 3/1897 | Load et al. | 403/93 |
| 3,773,094 | A | 11/1973 | Kuenzel | 81/177.9 |
| 4,787,276 | A | 11/1988 | Condon | 81/177.1 |
| 5,802,936 | A | 9/1998 | Liu | 81/450 |
| 5,943,921 | A | 8/1999 | Lin | 81/59.1 |
| 5,943,925 | A | 8/1999 | Huang | 81/177.2 |
| 6,145,413 | A | 11/2000 | Lin | 81/63.1 |
| 6,186,033 | B1 | 2/2001 | Faro | 81/177.7 |
| 6,401,576 | B1 | 6/2002 | Wu | 81/177.4 |
| 6,848,344 | B2 | 2/2005 | Rocco | 81/177.8 |
| 7,047,846 | B1 | 5/2006 | Hu | 81/177.7 |
| 7,174,810 | B1 | 2/2007 | Lin | 81/63.1 |
| 7,246,545 | B1 | 7/2007 | Lee | 81/177.9 |
| 7,287,450 | B1 | 10/2007 | Liao | 81/177.9 |
| 7,302,876 | B1 | 12/2007 | Lee et al. | 81/177.9 |
| 7,415,911 | B2 | 8/2008 | Cole et al. | 81/177.8 |

OTHER PUBLICATIONS

Taiwanese Patent Publication No. M279461, Nov. 1. 2005, 7 pp.
German Utility Model Publication No. DE 29616736 U1, Nov. 7, 1996, 10 pages.
European Patent Publication No. EP 1512498 A1, Mar. 9, 2005, 20 pages.

*Primary Examiner*—David B Thomas
(74) *Attorney, Agent, or Firm*—Banger Shia

(57) ABSTRACT

A multi-angle tool handle including a handle device, a connecting device and a locking unit adapted for connecting an interconnecting element to the handle device. The locking unit is moveable between a first position and a second position. When the locking unit is in the first position, the interconnecting element is able to pivot and slide with respect to the handle device. And when the locking unit is in the second position, the interconnecting element is fixed with respect to the handle device in position.

17 Claims, 13 Drawing Sheets

MULTI-ANGLE TOOL HANDLE

CROSS-REFERENCE TO RELATED PATENT APPLICATION

This application is a continuation-in-part application of application Ser. No. 12/042,455, filed Mar. 5, 2008 now U.S. Pat. No. 7,698,972, the contents of which are incorporated herein by reference.

BACKGROUND OF THE INVENTION

1. Field of the Invention

The present invention relates to a multi-angle tool handle.

2. Description of the Related Art

A conventional tool handle as shown in reference Taiwan Patent NO M279461, meanwhile, the tool handle includes a handle 1, a driving unit 2, a base cap 3 and a connecting stem 4. A pawl 21 is formed on an end of the driving unit 2 and disposed in a through-hole 13 which is defined through the handle 1. A pin 31 is formed on the top of the base cap 3 and adapted for abutting another end of the driving unit 2. A ratchet 42 is defined on an end of the connecting stem 4 adjacent to the driving unit 2. A teeth portion 43 is formed on the periphery of the ratchet 42 and allows the pawl 21 engaging therewith.

The connecting stem 4 can pivot relative to the driving unit 2 to various angles; however, the connecting stem 4 only can be fixed to a specific position for a stably operation by using a spring to maintain position of the driving unit 2.

The present invention is therefore intended to obviate or at least alleviate the problems encountered in prior art.

SUMMARY OF THE INVENTION

Briefly stated, the invention comprises a multi-angle tool handle including a handle device, a connecting device and a locking unit adapted for connecting an interconnecting element to the handle device. The locking unit is moveable between a first position and a second position. When the locking unit is in the first position, the interconnecting element is able to pivot and slide with respect to the handle device. And when the locking unit is in the second position, the interconnecting element is fixed with respect to the handle device in position.

The primary advantage of the multi-angle tool handle according to the present invention is to provide various shapes tool handle for operation so that user can operate in different conditions and achieve the purposes of effort-saving and time-saving both.

Other advantages and features of the present invention will become apparent from the following descriptions referring to the drawings.

BRIEF DESCRIPTION OF THE DRAWINGS

The present invention will be described via detailed illustration of the preferred embodiment referring to the drawings.

DETAILED DESCRIPTION OF THE PREFERRED EMBODIMENT

Figure 1:
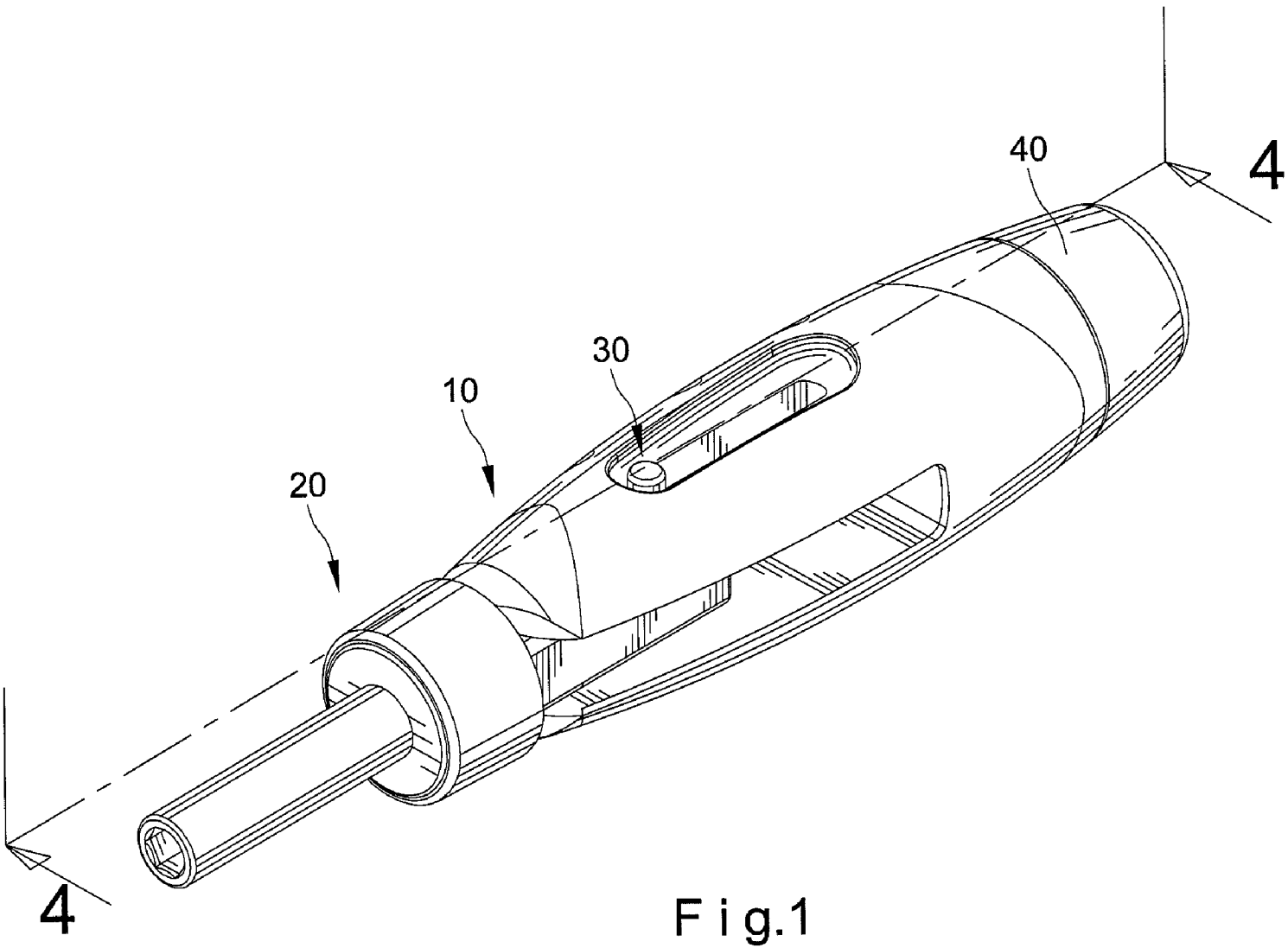
FIG. 1 is a perspective view of a multi-angle tool handle according to the first embodiment of the present invention.
Figure 2:
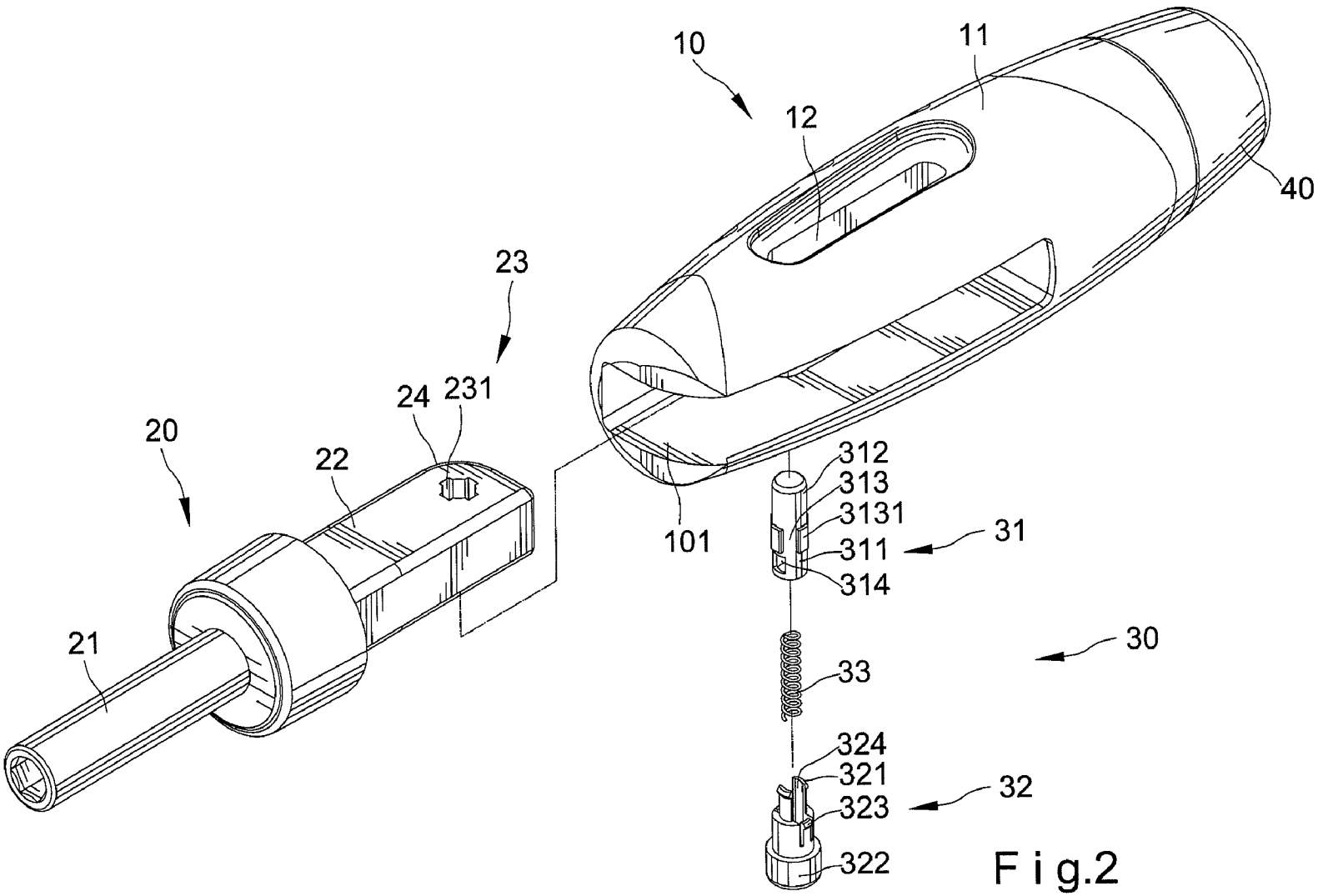
FIG. 2 is an exploded view of the multi-angle tool handle shown in FIG. 1.
Figure 3:
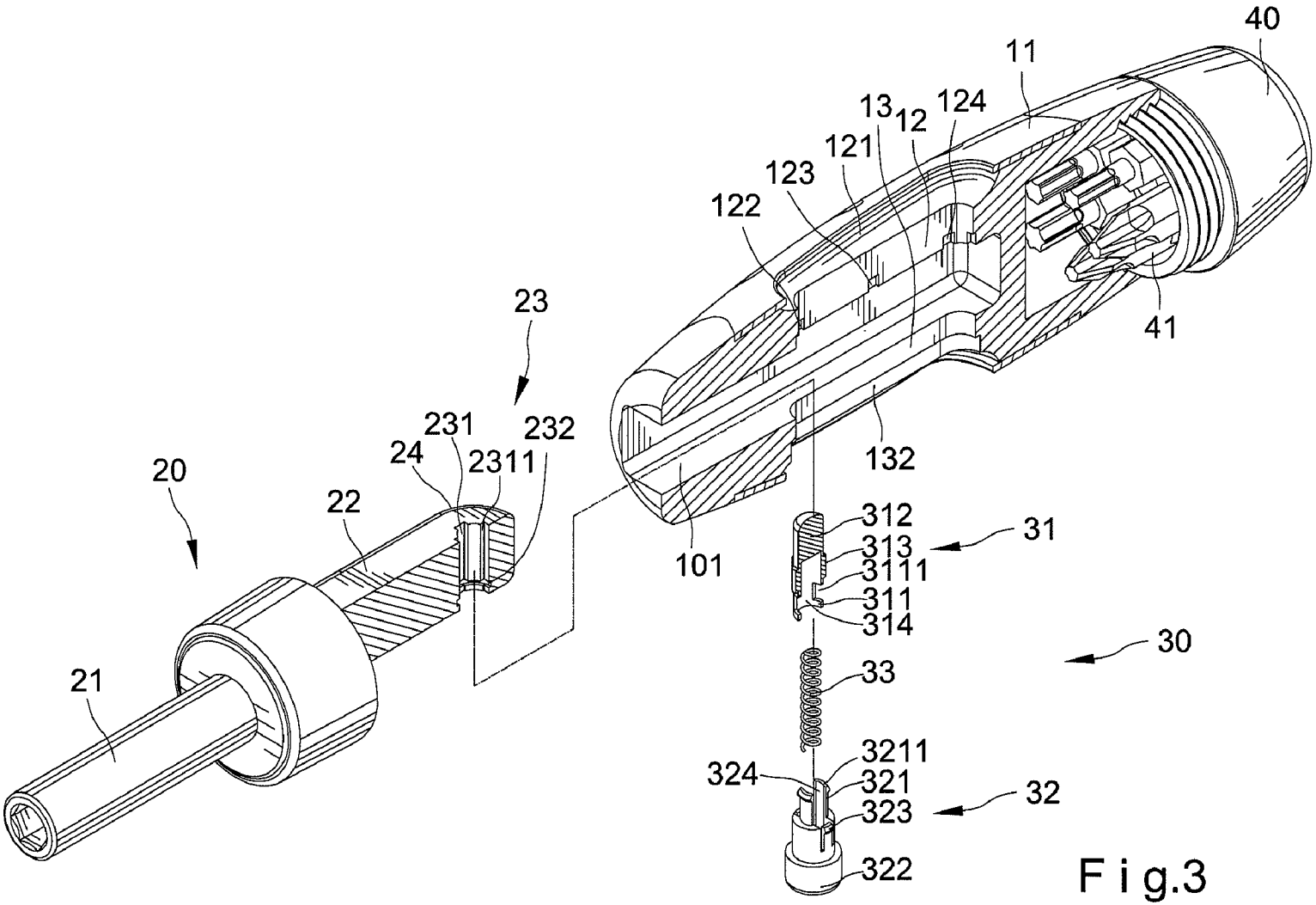
FIG. 3 is a partial cross-sectional view of the handle device and the interconnecting element of the multi-angle tool handle shown in FIG. 2.

Referring to FIGS. 1 through 6, a multi-angle tool handle in accordance with a first embodiment in the present invention includes a handle device 10, a connecting device 20, a locking unit 30 and a cap 40.

The handle device 10 includes a compartment 101 formed on a first end thereof and being open to a side thereof, and the cap 40 is engaged with a second end of the handle device 10 opposite to the first end of the handle device 10. Various sizes of bits 41 are received between the cap 40 and the handle device 10. A body 11 is defined between the first and second ends of the handle device 10 and communicates with the compartment 101. A first slide slot 12 and a second slide slot 13 are respectively defined at the top and bottom sides of the body 11, and the compartment 101 is sandwiched between and communicates with the first and second slide slots 12 and 13. Arcuate recesses 121 and 131 are respectively formed on the top and bottom sides of the body 11 and extend from the first and second slide slots 12 and 13 for a comfortable operation. A receptacle 132 is defined between the recess 131 and the second slide slot 13, and a limited edge 133 is defined between the receptacle 132 and the recess 131. A first positioned portion 122, a second positioned portion 123 and a third positioned portion 124 are provided on an inner side of the first slide slot 12 and proximal to the compartment 101. The first and third positioned portions 122 and 124 are respectively at two ends of the first slide slot 12 and the second positioned portion 123 is between the first and third positioned portions 122 and 124.

The connecting device 20 includes an interconnecting end 22 defined at an end thereof and moveably received in the compartment 101 and a connecting end 21 defined at another end thereof opposite to the interconnecting end 22. The interconnecting end 22 is slideably disposed in the compartment 101 between the first and second slide slots 12 and 13 via the locking unit 30 engaged with an interconnecting hole 23 which is defined at the interconnecting end 22. The interconnecting hole 23 longitudinally pierces through the distal end of the interconnecting end 22 opposite to the connecting end 21 and respectively communicates with the first and second slide slots 12 and 13. A clamping portion 231 is provided on the inner surface of the interconnecting hole 23, and four longitudinal depressions 2311 are formed on the clamping portion 231 and respectively opened to the top and bottom sides of the interconnecting end 22. As the interconnecting end 22 is pivoted to be parallel to or perpendicular to the body 11 of the handle device 10, each depression 2311 can be correspond to one of the first, second and third positioned portions 122, 123 and 124. An annular groove 232 is formed on the inner surface of the interconnecting hole 23 proximal to the bottom side of the interconnecting end 22. A chamfering portion 24 is provided on the outer periphery of the distal end of the interconnecting end 22 against the bottom of the compartment 101.

The locking unit 30 is slideably installed along the compartment 101 between the first and second slide slots 12 and 13 and coupled to the interconnecting hole 23. The locking unit 30 is moveable between a first position and a second position. While the locking unit 30 is in the first position, the locking unit 30 is adapted to drive the connecting device 20 to slide along the compartment 101 and further the connecting device 20 is able to pivot with respect to the handle device 10. While the locking unit 30 is in the second position, the locking unit 30 is adapted to limit the connecting device 20 not to slide along the compartment 101 and not to pivot with respect to the handle device 10.

The locking unit 30 includes a first locking element 31, a second locking element 32 and an elastic element 33. The first locking element 31 is provided in the first slide slot 12 of the body 11 and includes a first coupled portion 311 formed on an end thereof, a pressing portion 312 formed on another end thereof and a fastening portion 313 provided on the outer periphery thereof between the coupled and pressing portions 311 and 312. Four projections 3131 protrudes from the fastening portion 313. Two orifices 3111 are formed on the outer periphery of the first locking element 31 between the coupled and fastening portions 311 and 313. The projections 3131 of the fastening portion 313 are disposed in the depressions 2311 of the clamping portion 231. The pressing portion 312 exposes from the handle device 10. A first receiving portion 314 is formed in the first locking element 31 and opened toward the second slide slot 13.

The second locking element 32 is provided in the second slide slot 13 of the body 11 and includes a second coupled portion 321 defined on an end thereof, a base portion 322 defined on another end thereof and a clamping portion 323 formed on the outer periphery thereof between the second coupled and base portions 321 and 322. The second coupled portion 321 has two hooks 3211 protruding from the distal end thereof outwardly and spaced from each other. A second receiving portion 324 is defined in the second locking element 32 and opened toward the first locking element 31. The second receiving portion 324 is sandwiched by the hooks 3211. The hooks 3211 of the second coupled portion 321 are respectively engaged with the orifices 3111 for engaging the first and second locking elements 31 and 32 with each other. The clamping portion 323 is engaged with the annular groove 232 for attaching the locking unit 30 to the interconnecting end 22 of the connecting device 20. And the base portion 322 is slideably disposed in the receptacle 132. Moreover, the elastic element 33 is disposed between the first and second receiving portions 314 and 324 and provides the first locking element 31 an upward push force from the handle device 10.

While the fastening portion 313 is driven to direct the first positioned portion 122, the first locking element 31 is pushed by the elastic element 33 upward as to engage the projections 3131 of the fastening portion 313 with the first positioned portion 122 and further fix the interconnecting end 22 with respect to the handle device 10 in position. Moreover, the length of each projection 3131 is smaller than that of each depression 2311 and larger than that of one of the first, second and third positioned portions 122, 123 and 124. Therefore, the projections 3131 of the fastening portion 313 are able to engage with the depressions 2311 and one of the first, second and third positioned portions 122, 123 and 124 simultaneously.

Figure 7:
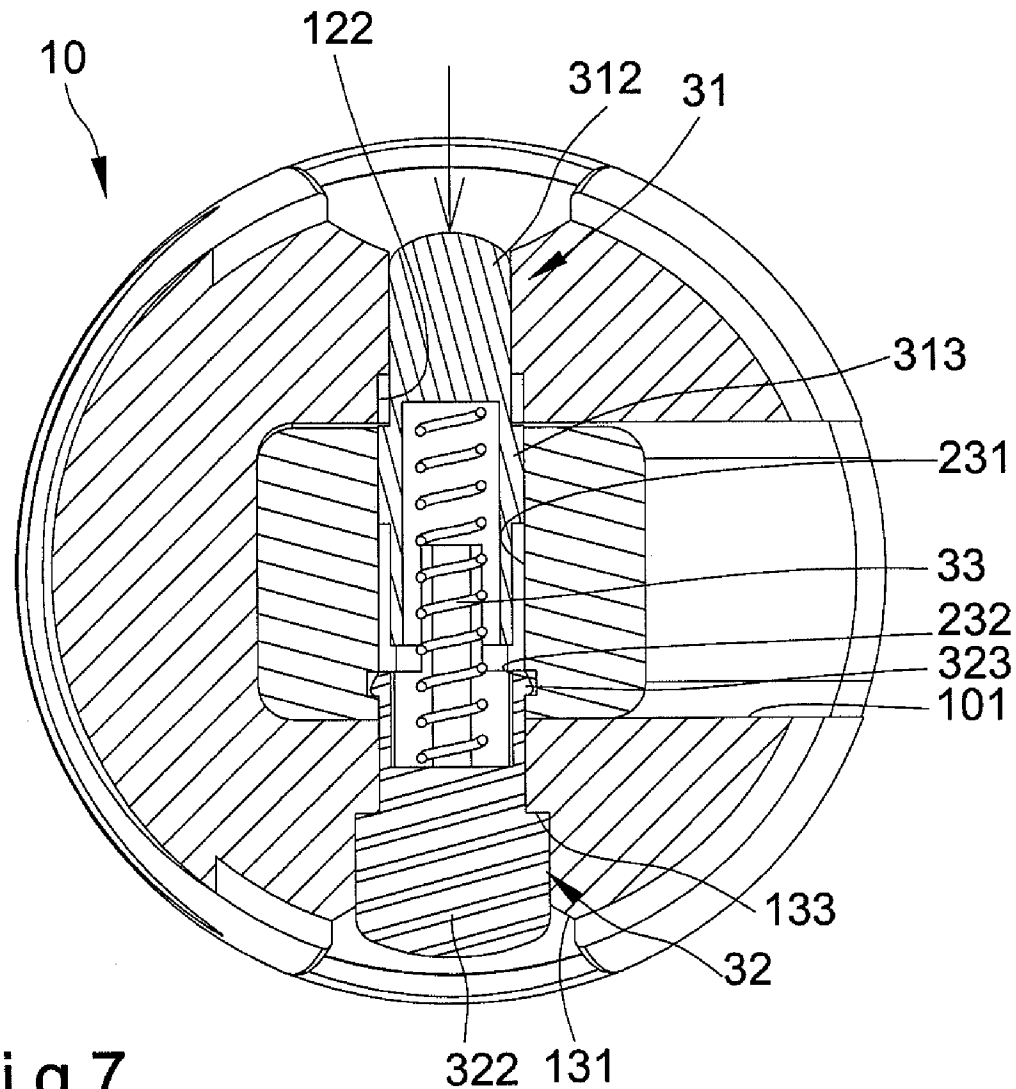
FIG. 7 is a cross-sectional view similar to FIG. 6, illustrating the first locking element being pressed for disengaging the second coupled portion of the second locking element from the orifices of the first locking element.
Figure 8:
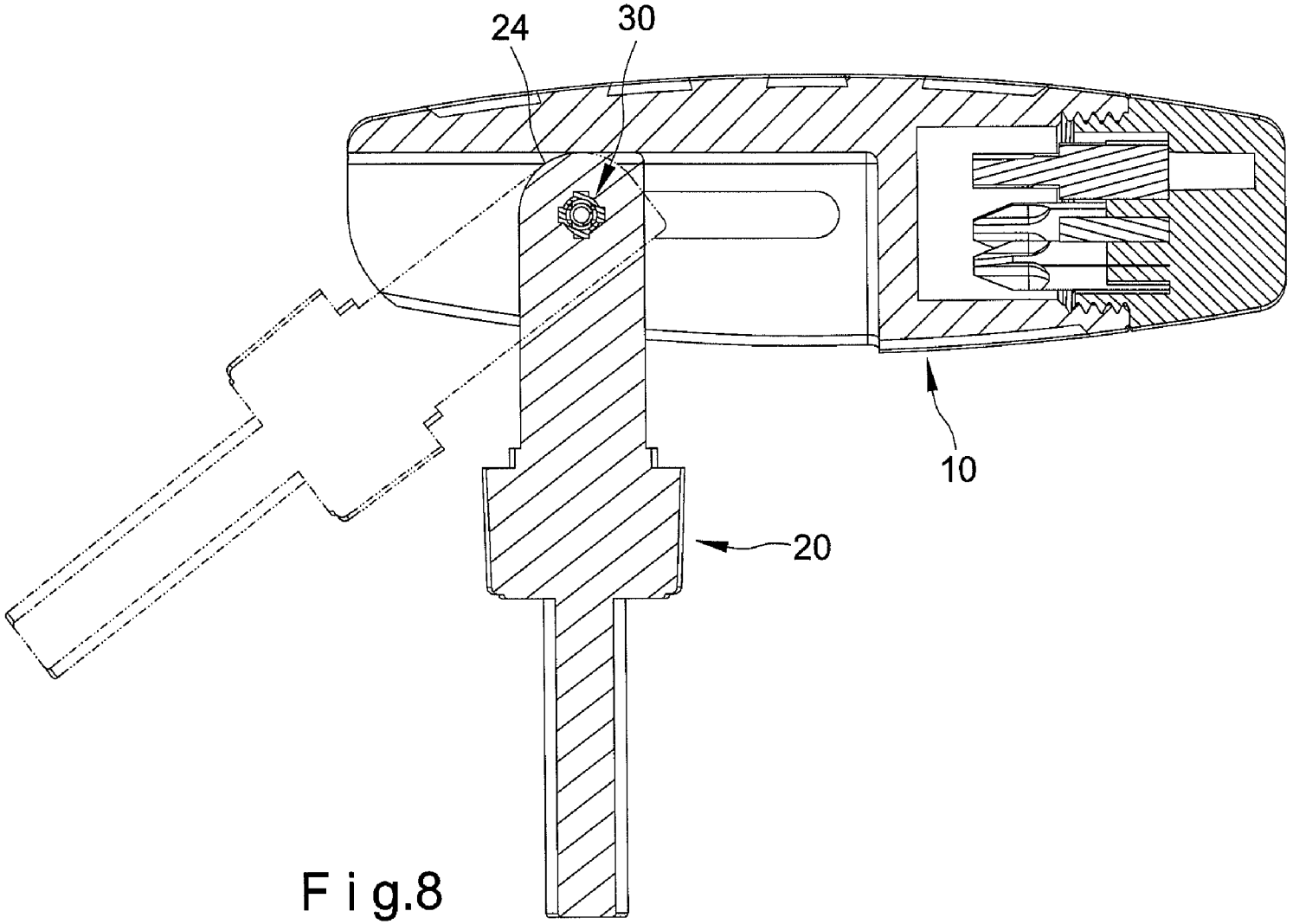
FIG. 8 is a top view of the multi-angle tool handle of FIG. 1.

Referring to FIGS. 7 and 8, the first locking element 31 is operated to move to the first position by pressing the pressing portion 312 downward, the projections 3131 of the fastening portion 313 is disengaged from the first positioned portion 122 and moves toward the depressions 2311 of the clamping portion 231 so that the interconnecting end 22 of the connecting device 20 is able to pivot with respect to the handle device 10 and slides along the compartment 101 between the first and second slide slots 12 and 13. Then, the connecting device 20 is pivoted to form the multi-angle tool handle being L-shaped as shown in FIG. 8, and the first locking element 31 is driven to move to the second position by releasing the pressing portion 312 as to fix the interconnecting end 22 of the connecting device 20 with respect to the handle device 10 in position.

Figure 9:
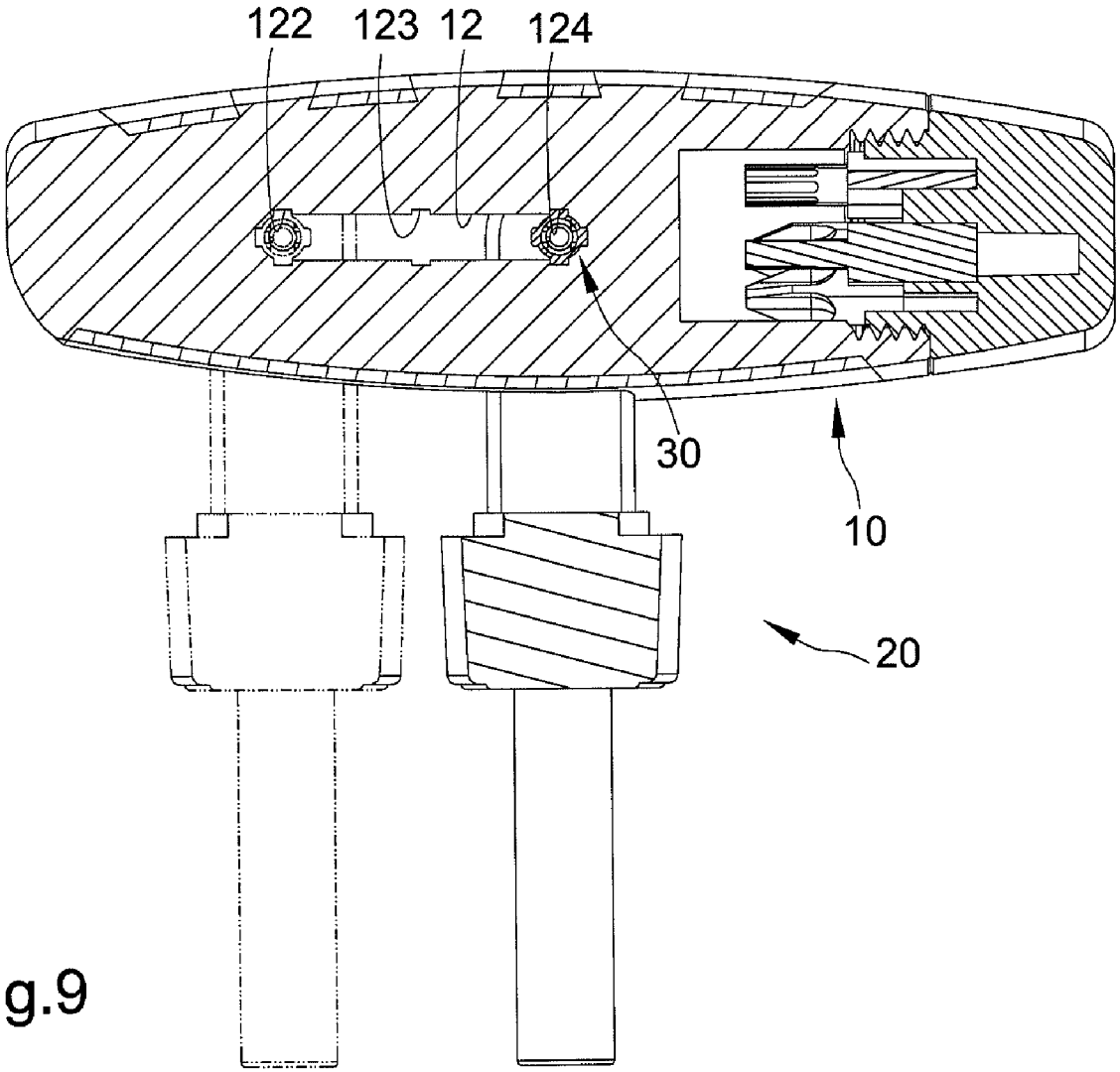
FIG. 9 is another top view of the multi-angle tool handle of FIG. 1.
Figure 10:
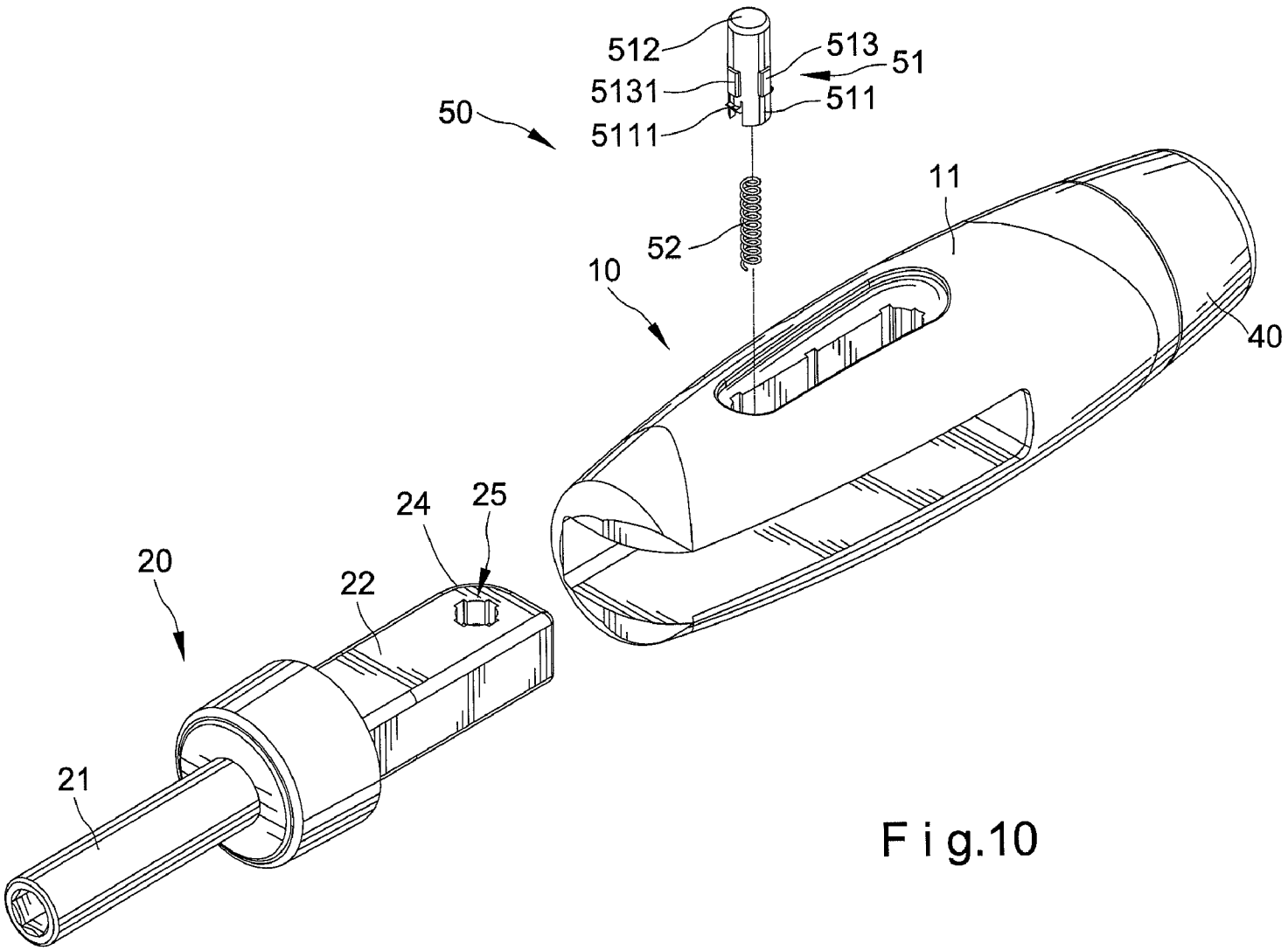
FIG. 10 is an exploded view of a multi-angle tool handle according to the second embodiment of the present invention.
Figure 11:
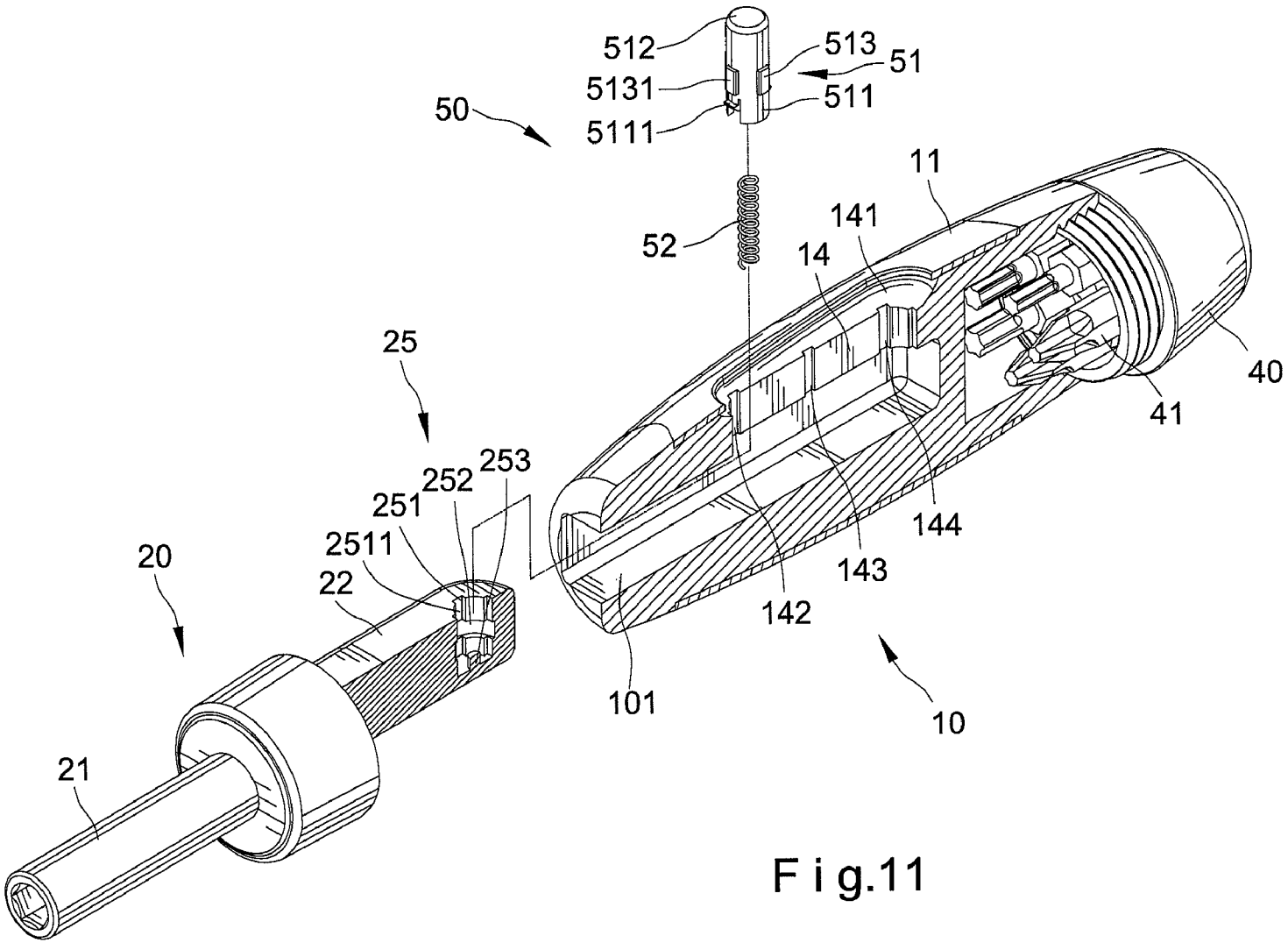
FIG. 11 is a partial cross-sectional view of the handle device and the interconnecting element of the multi-angle tool handle shown in FIG. 10.
Figure 12:
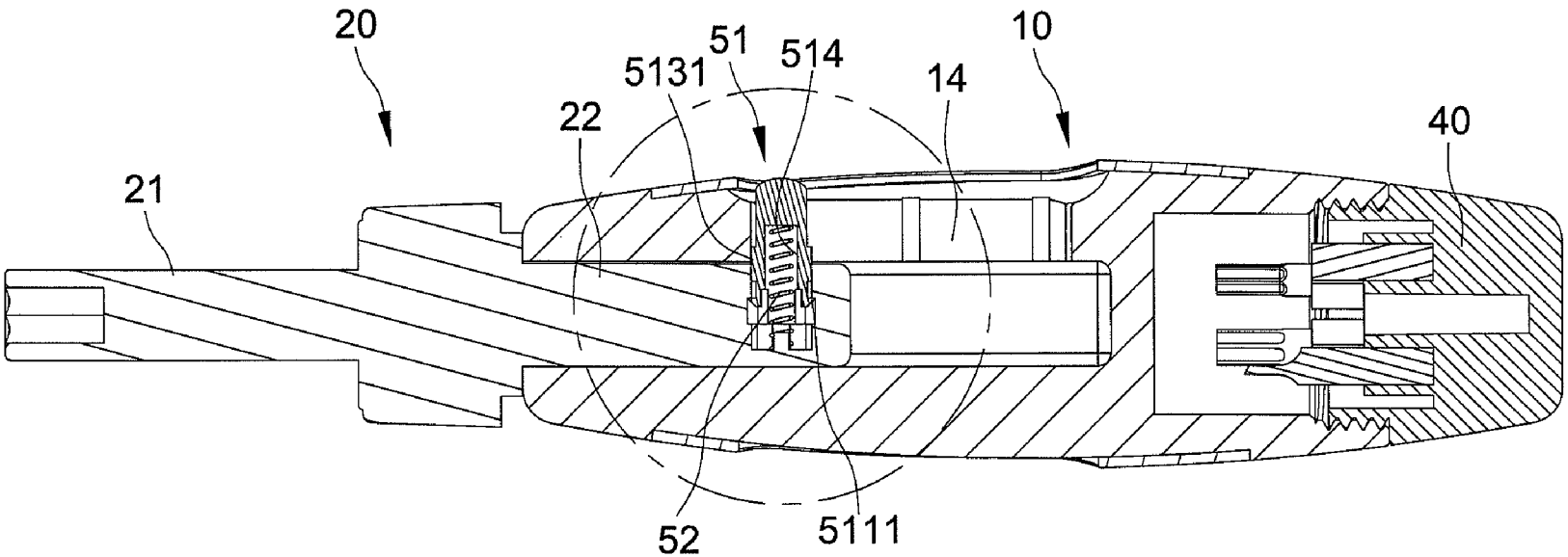
FIG. 12 is a cross-sectional view of the multi-angle tool handle shown in FIG. 10.
Figure 13:
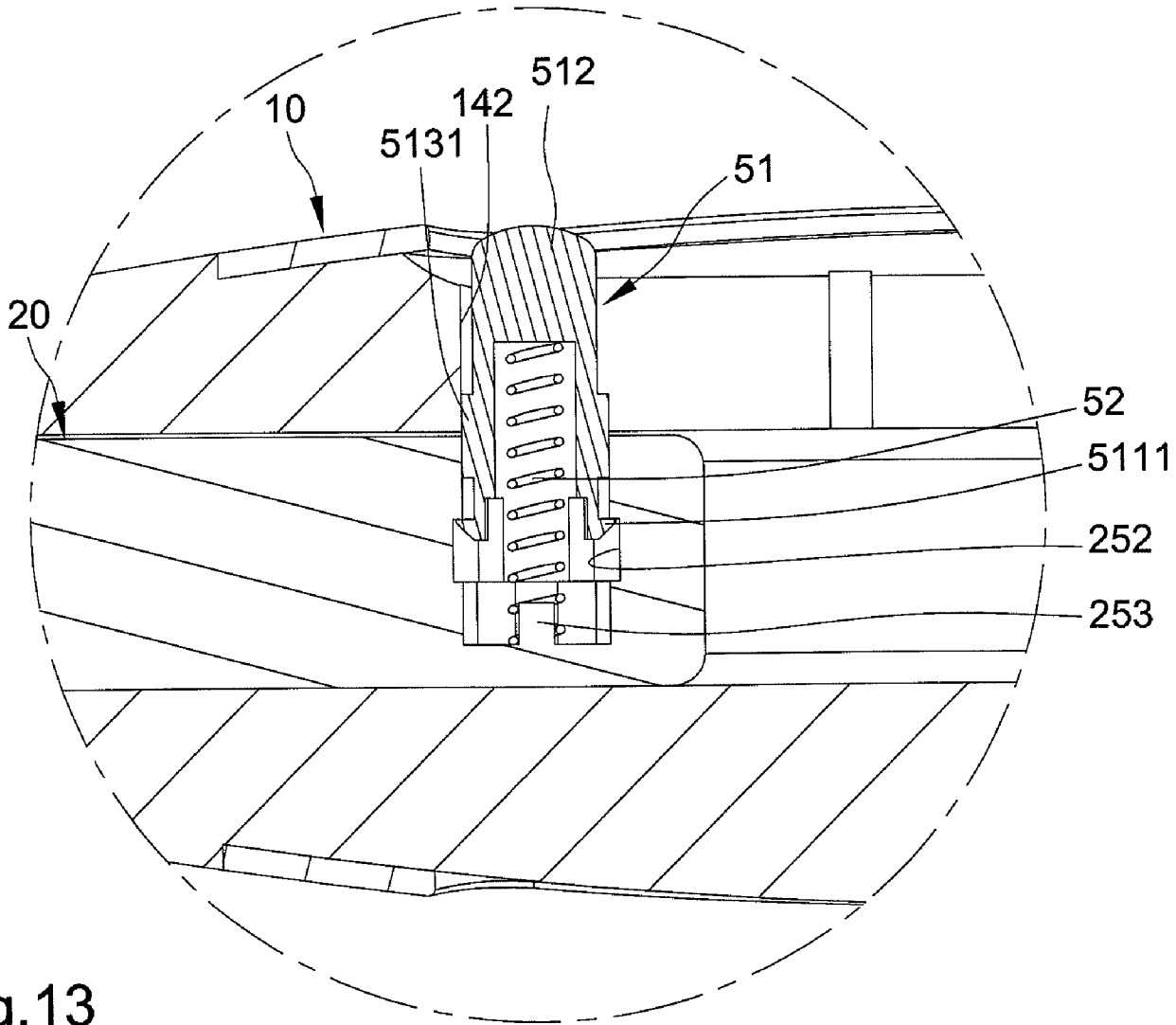
FIG. 13 is an enlarged view the multi-angle tool handle of FIG. 12.

In addition, the connecting device 20 is able to slide along the compartment 101 as the first locking element 31 is in the first position by pressing the pressing portion 312. Referring to FIG. 9, the connecting device 20 is driven to slide for positioning with respect to the third positioned portion 124 of the handle device 10 as to form the multi-angle tool handle being T-shaped.

Figure 4:
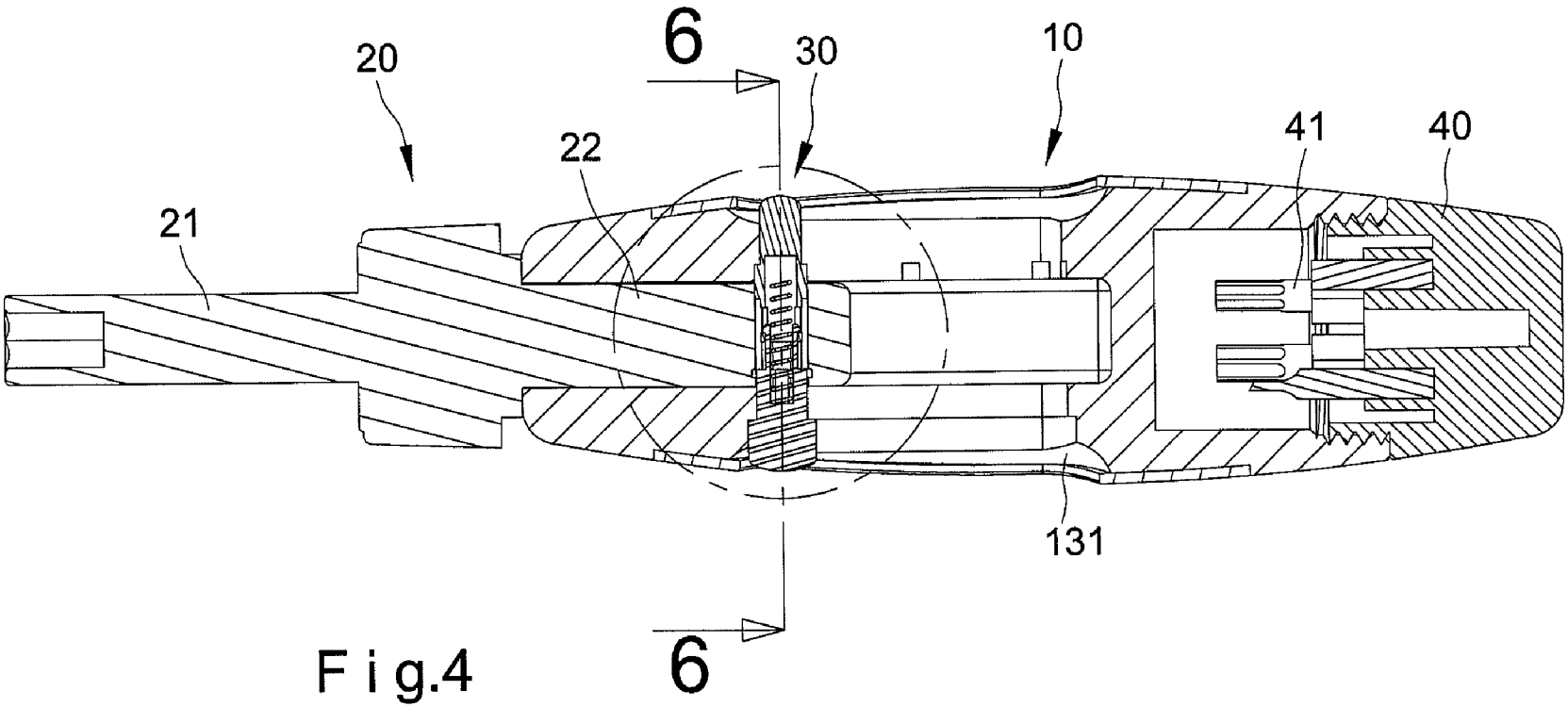
FIG. 4 is a cross-sectional view of the multi-angle tool handle taken along a line 4-4 shown in FIG. 1.
Figure 5:
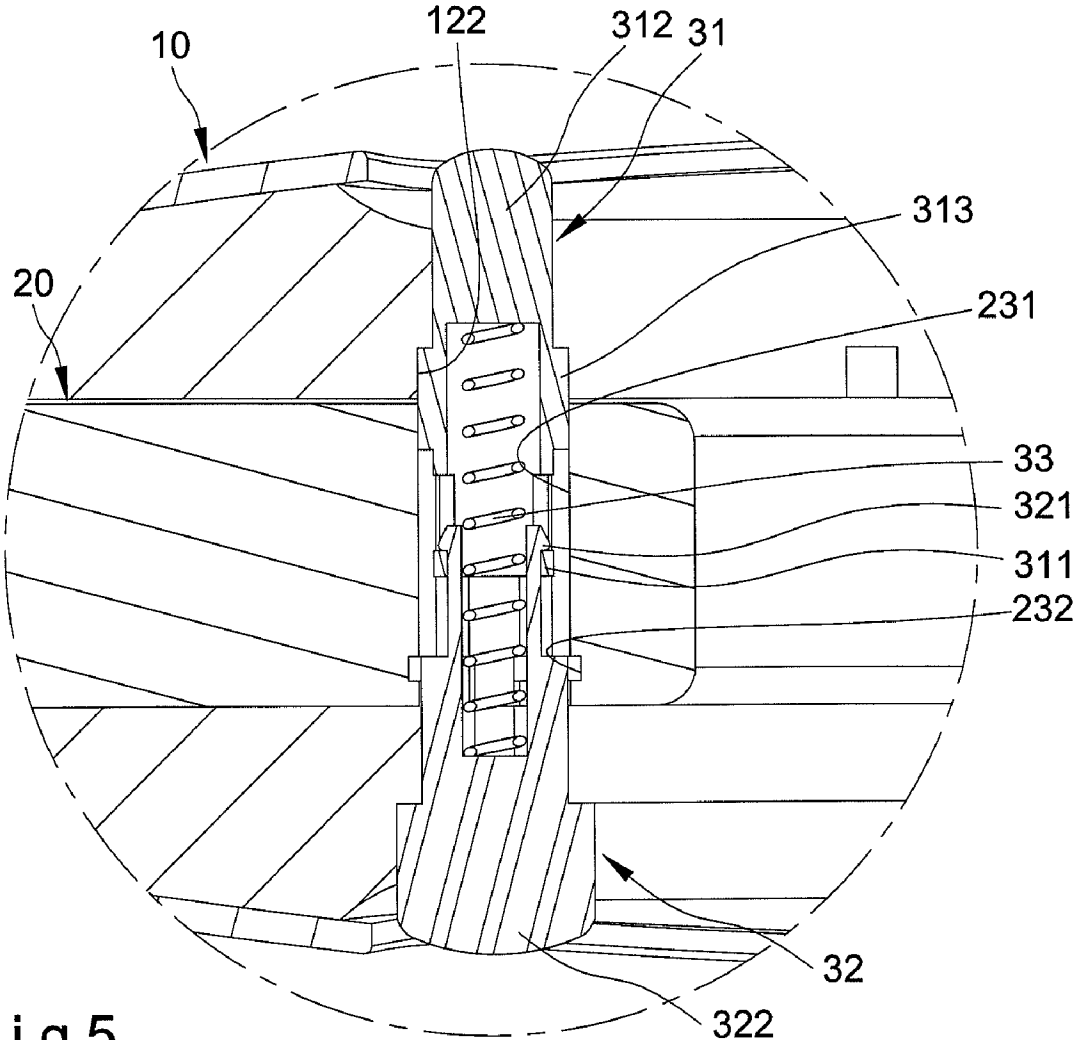
FIG. 5 is an enlarged view the multi-angle tool handle of FIG. 4.
Figure 6:
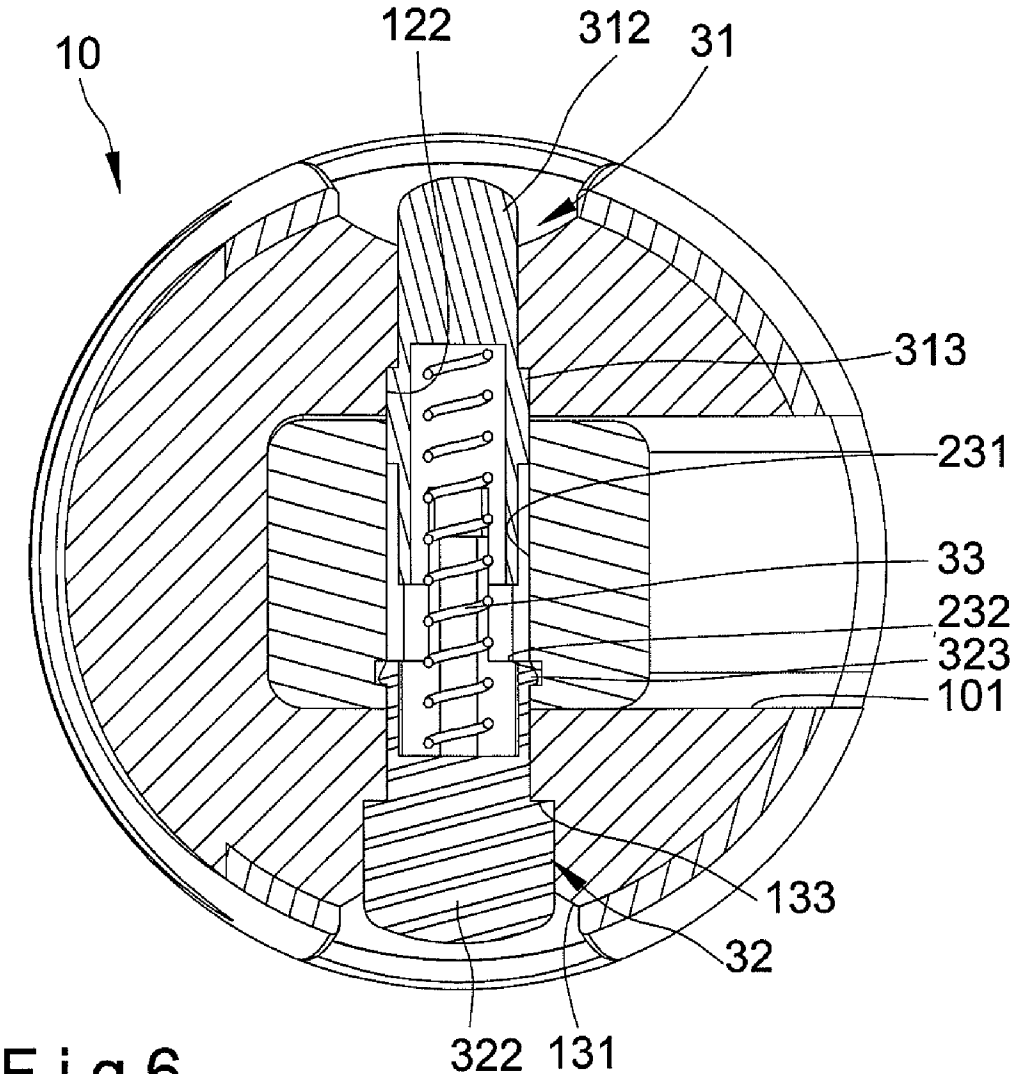
FIG. 6 is a cross-sectional view of the multi-angle tool handle taken along a line 6-6 shown in FIG. 4.

Further referring to FIG. 4, the multi-angle tool handle is in form of I-shaped before the connecting device 20 is pivoted with respect to the handle device 10. Users can operate the I-shaped multi-angle tool handle for an advantage of time-saving.

Further referring to FIG. 8, the multi-angle tool handle is in form of L-shaped after the connecting device 20 is pivoted with respect to the handle device 10 and positioned with respect to the first positioned portion 122. Users can operate the L-shaped multi-angle tool handle for an advantage of effect-saving.

Further referring to FIG. 9, the multi-angle tool handle is in form of T-shaped after the connecting device 20 is pivoted with respect to the handle device 10 and then is driven to slide along the compartment 101 of the handle device 10 to be positioned with respect to the third positioned portion 124. Users can operate the T-shaped multi-angle tool handle for advantages of effect-saving and time-saving.

Referring to FIGS. 10 through 13, a multi-angle tool handle in accordance with a second embodiment in the present invention similar to the first embodiment except for several features.

First, an interconnecting hole 25 replaces the interconnecting hole 23. The interconnecting hole 25 is defined at the interconnecting end 22 and longitudinally formed on the distal end of the interconnecting end 22 opposite to the connecting end 21. A clamping portion 251 is provided on the inner surface of the interconnecting hole 25, and four longitudinal depressions 2511 are formed on the clamping portion 251 and only opened to the top side of the interconnecting end 22. A protrusion 253 is defined in the interconnecting hole 25 and protrudes from the bottom of the interconnecting hole 25. A coupled portion 252 is defined on the inner surface of the clamping portion 251 and between the depressions 2511 and the protrusion 253.

Secondly, a slide slot 14 replaces the first slide slot 12, and the second slide slot 13 is omitted so that the body 11 of the handle 10 is only opened to the top side thereof and the compartment 101 is provided between the slide slot 14 and the bottom side of the body 11 of the handle device 10. An Arcuate recess 141 is formed on the top side of the body 11 and extends from the slide slot 14 for a comfortable operation. A first positioned portion 142, a second positioned portion 143 and a third positioned portion 144 are provided on an inner side of the slide slot 14 and proximal to the compartment 101. The first and third positioned portions 142 and 144 are respectively at two ends of the slide slot 14 and the second positioned portion 143 is between the first and third positioned portions 142 and 144.

Thirdly, a locking unit 50 replaces the locking unit 30 and adapted for engaging the interconnecting hole 25 of the interconnecting end 22 with the handle device 10. The locking unit 50 includes a locking element 51 and an elastic element 52. The locking element 51 is provided in the slide slot 14 of the body 11 and includes a coupled portion 511 formed on an end thereof, a pressing portion 512 formed on another end thereof and a fastening portion 513 provided on the outer periphery thereof between the coupled and pressing portions 511 and 512. Two hooks 5111 extend from the distal end of the coupled portion 511 outward and are spaced from each other. Four projections 5131 protrudes from the fastening portion 513. A receiving portion 514 is formed in the locking element 1 and opened toward the bottom side of the body 11 and sandwiched by the hooks 5111. The elastic element 52 is disposed between the receiving portion 514 and the protrusion 253 of the interconnecting hole 25 and provides the locking element 51 an upward push force from the handle device 10. The hooks 5111 of the locking element 51 are engaged with the coupled portion 252 for positioning the locking element 50 in the interconnecting hole 25. While the coupled portion 513 is driven to direct the first positioned portion 142, the locking element 51 is pushed by the elastic element 53 upward as to engage the projections 5131 of the fastening portion 513 with the first positioned portion 142 and further fix the interconnecting end 22 with respect to the handle device 10 in position.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A multi-angle tool handle comprising:

a handle device which has a first and a second ends including a compartment formed on the first end thereof and a body defined between the first and second ends of the handle device and communicates with the compartment;

at least two positioned portions formed in the body and proximal to the compartment;

a connecting device including an interconnecting end defined and slideably disposed in the compartment, with the interconnecting end having an interconnecting hole longitudinally formed thereon and corresponding to the compartment; and a locking unit which is slideably disposed in the compartment and coupled to the interconnecting hole and moveable between a first position and a second position;

wherein when the locking unit is in the first position, the connecting device is able to pivot and slide with respect to the handle device;

wherein when the locking unit is in the second position, the connecting device is fixed with respect to the handle device in position.

2. The multi-angle tool handle as claimed in claim 1, with the interconnecting hole having a clamping portion formed on the inner surface thereof, and with the locking unit having a fastening portion formed on the outer periphery thereof; wherein when the locking unit is in the first position, the fastening portion is disengaged form the positioned portion and engaged with the clamping portion; wherein when the locking unit is in the second position, the fastening portion is respectively engaged with the positioned portion and the clamping portion.

3. The multi-angle tool handle as claimed in claim 2, wherein the locking unit further includes a first locking element, a second locking element coupled to the first locking element and an elastic element received between the first and second locking elements, with the fastening portion formed on the first locking element.

4. The multi-angle tool handle as claimed in claim 3, further comprising a first coupled portion and a second coupled portion respectively defined at the first and second locking elements for coupling the first and second locking elements to each other.

5. The multi-angle tool handle as claimed in claim 3, further comprising a clamping portion formed on the second locking element and an annular groove formed on the inner surface of the interconnecting hole, with the clamping portion of the second locking element adapted to engage with the annular groove for fixing the locking unit to the connecting device.

6. The multi-angle tool handle as claimed in claim 3, further comprising a pressing portion defined on the first locking element opposite to the first coupled portion and adapted to be pressed to drive the locking unit between the first and second position.

7. The multi-angle tool handle as claimed in claim 2, wherein the locking unit further includes a locking element and an elastic element received between the locking element and the interconnecting hole, with the fastening portion formed on the locking element.

8. The multi-angle tool handle as claimed in claim 7, further comprising a coupled portion, which is defined in the locking element, and a coupled portion formed on the inner surface of the interconnecting hole and coupled to the locking element for fixing the locking unit to the connecting device.

9. The multi-angle tool handle as claimed in claim 7, further comprising a pressing portion defined on the locking element opposite to the coupled portion and adapted to be pressed to drive the locking unit between the first and second position.

10. The multi-angle tool handle as claimed in claim 8, further comprising a protrusion formed on the bottom of the interconnecting hole, with the elastic element disposed between the protrusion and the locking element, with the coupled portion being between the clamping portion and the protrusion.

11. The multi-angle tool handle as claimed in claim 2, further comprising a slide slot defined at the top side of the body, with the positioned portions formed on the slide slot.

12. The multi-angle tool handle as claimed in claim 11, with the length of fastening portion being smaller than that of clamping portion and larger than that of one of the positioned portions.

13. The multi-angle tool handle as claimed in claim 1 further comprising a first slide slot and a second slide slot respectively defined at the top and bottom sides of the body, with the compartment sandwiched between and communicates with the first and second slide slots.

14. The multi-angle tool handle as claimed in claim 13, further comprising a first positioned portion, a second positioned portion and a third positioned portion provided on an inner side of the first slide slot and proximal to the compartment 101, with the first and third positioned portions being respectively at two ends of the first slide slot and the second positioned portion being between the first and third positioned portions.

15. The multi-angle tool handle as claimed in claim 14 wherein by operation of the locking device in the first position, the connecting device is positioned as to form the multi-angle tool handle being L-shaped.

16. The multi-angle tool handle as claimed in claim 14, wherein by operation of the locking device in the first position, the connecting device is positioned as to form the multi-angle tool handle being T-shaped.

17. The multi-angle tool handle as claimed in claim 1, further comprising a cap engaged with the second end of the handle device opposite to the compartment and including various sizes of bits received between the cap and the handle device.

* * * * *